US008672370B2

(12) United States Patent
Abel et al.

(10) Patent No.: US 8,672,370 B2
(45) Date of Patent: Mar. 18, 2014

(54) FURNACE DOOR LATCH ASSEMBLY

(75) Inventors: John N. Abel, Avon, IN (US); Nitu Gupta, Westfield, IN (US)

(73) Assignee: Carrier Corporation, Farmington, CT (US)

( * ) Notice: Subject to any disclaimer, the term of this patent is extended or adjusted under 35 U.S.C. 154(b) by 181 days.

(21) Appl. No.: 13/253,244

(22) Filed: Oct. 5, 2011

(65) Prior Publication Data

US 2012/0086221 A1 Apr. 12, 2012

Related U.S. Application Data

(60) Provisional application No. 61/390,334, filed on Oct. 6, 2010.

(51) Int. Cl.
*E05C 3/04* (2006.01)

(52) U.S. Cl.
USPC ..... 292/218; 292/1; 292/DIG. 38

(58) Field of Classification Search
CPC ... E05B 83/10; E05B 85/243; E05B 65/0811; E05B 85/08; E05B 3/065; E05B 3/04; E05C 1/163; E05C 3/042
USPC ..... 292/240, DIG. 38, 194, 195, 198, 200, 292/202, 347, 348, 350, DIG. 53, DIG. 54, 292/DIG. 63, 1, 8, 24, 25, 32, 57, 117, 292/336.3, 258, 288; 70/207, 270, 206, 70/224, 218
See application file for complete search history.

(56) References Cited

U.S. PATENT DOCUMENTS

| | | | | | |
|---|---|---|---|---|---|
| 266,388 | A * | 10/1882 | Prouty | 292/336.3 |
| 4,078,835 | A * | 3/1978 | Spencer | 292/206 |
| 4,838,056 | A * | 6/1989 | Weinerman et al. | 70/208 |
| 4,880,262 | A * | 11/1989 | Mugnolo et al. | 292/202 |
| 4,910,982 | A * | 3/1990 | Dana | 70/370 |
| 5,413,392 | A * | 5/1995 | Schlack et al. | 292/204 |
| 5,630,632 | A * | 5/1997 | Swan | 292/240 |
| 6,953,209 | B2 * | 10/2005 | Jackson et al. | 292/66 |
| 2008/0203736 | A1 * | 8/2008 | Ramsauer | 292/58 |

* cited by examiner

*Primary Examiner* — Carlos Lugo
*Assistant Examiner* — Nathan Cumar
(74) *Attorney, Agent, or Firm* — Cantor Colburn LLP

(57) ABSTRACT

A latch assembly for securing a furnace door to a furnace casing, the latch assembly comprising: a latch for placement on an inside of the furnace door; a knob for placement through a hole in the furnace door, the knob snapped into the latch, the knob for placement on a front surface of the furnace door; a gasket for placement between the knob and the latch; and a cap secured at an end of the knob, wherein the latch, knob, and cap are keyed to allow assembly in only one orientation.

11 Claims, 3 Drawing Sheets

FURNACE DOOR LATCH ASSEMBLY

CROSS-REFERENCE TO RELATED APPLICATIONS

This application is a non-provisional application of U.S. Provisional Patent Application No. 61/390,334 filed Oct. 6, 2010, the entire contents of which are incorporated herein by reference.

BACKGROUND OF THE INVENTION

The subject matter disclosed herein generally relates to furnaces, and in particular to a furnace door latch assembly.

Furnaces often include doors to provide access to internal components. Door latches are used to secure the door to the furnace cabinet, and allow for the door to be opened. Embodiments of the invention relate to improvements in furnace door latches.

BRIEF DESCRIPTION OF THE INVENTION

An embodiment is a latch assembly for securing a furnace door to a furnace casing, the latch assembly comprising: a latch for placement on an inside of the furnace door; a knob for placement through a hole in the furnace door, the knob snapped into the latch, the knob for placement on a front surface of the furnace door; a gasket for placement between the knob and the latch; and a cap secured at an end of the knob, wherein the latch, knob, and cap are keyed to allow assembly in only one orientation.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
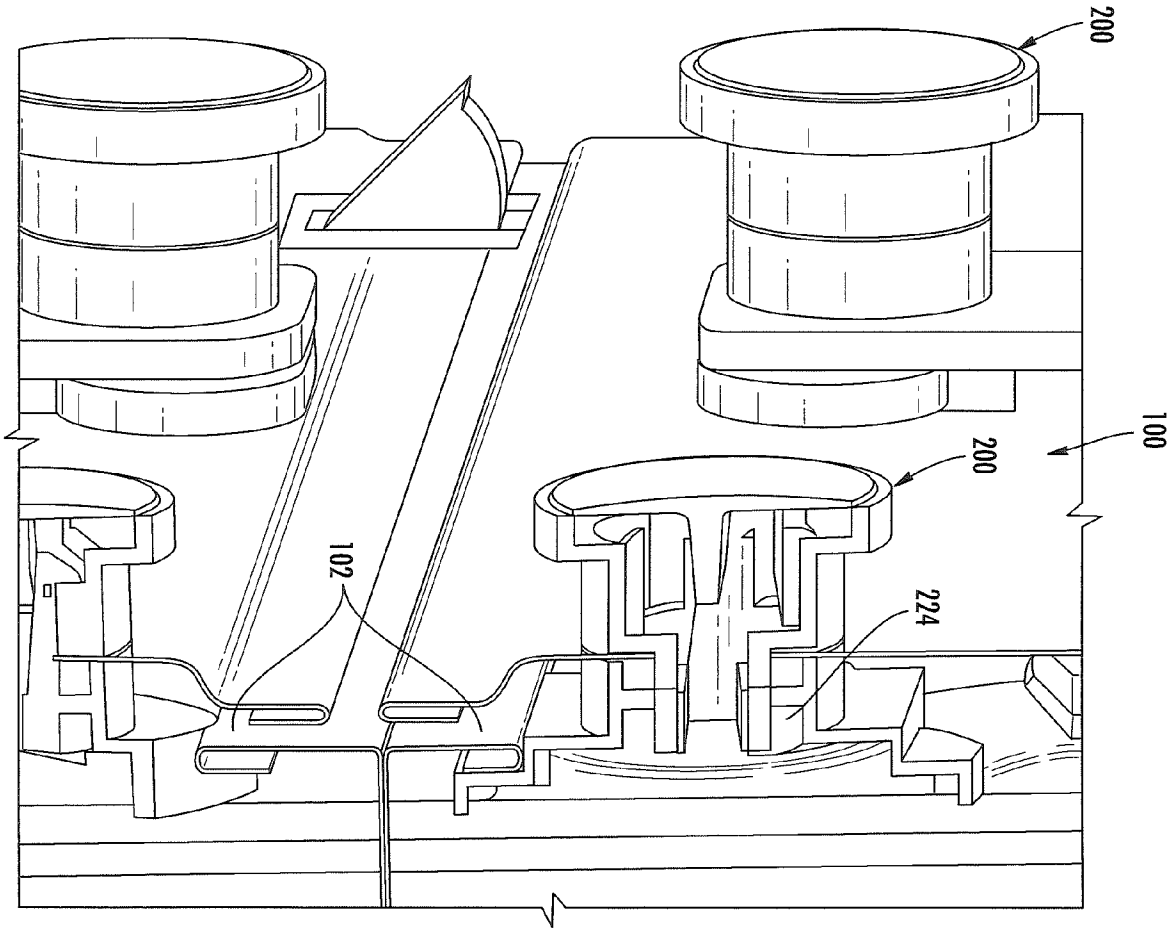
FIG. 1 is a perspective, partial cross-sectional view of latches mounted to a furnace door.

Latch assemblies according to embodiments of the invention are used to secure doors on a furnace. Referring to FIG. 1, access to compartments in furnace is available through doors 100 attached to casing 102. In exemplary embodiments, two doors may be used, one to access an upper compartment housing the heat exchangers and one to access a lower compartment housing the controller 54 and blower 26. A shown in FIG. 1, latch assemblies 200 secure door 100 to furnace casing 102. As described in further detail herein, latch assemblies 200 can be rotated clockwise or counter-clockwise and include two latch tabs. This allows the latch assemblies 200 to be used in multiple orientations (e.g., top of door and bottom of door) so that only one latch design is needed and doors can be moved from a top location to a bottom location by reorienting the latch assemblies 200.

Figure 2:
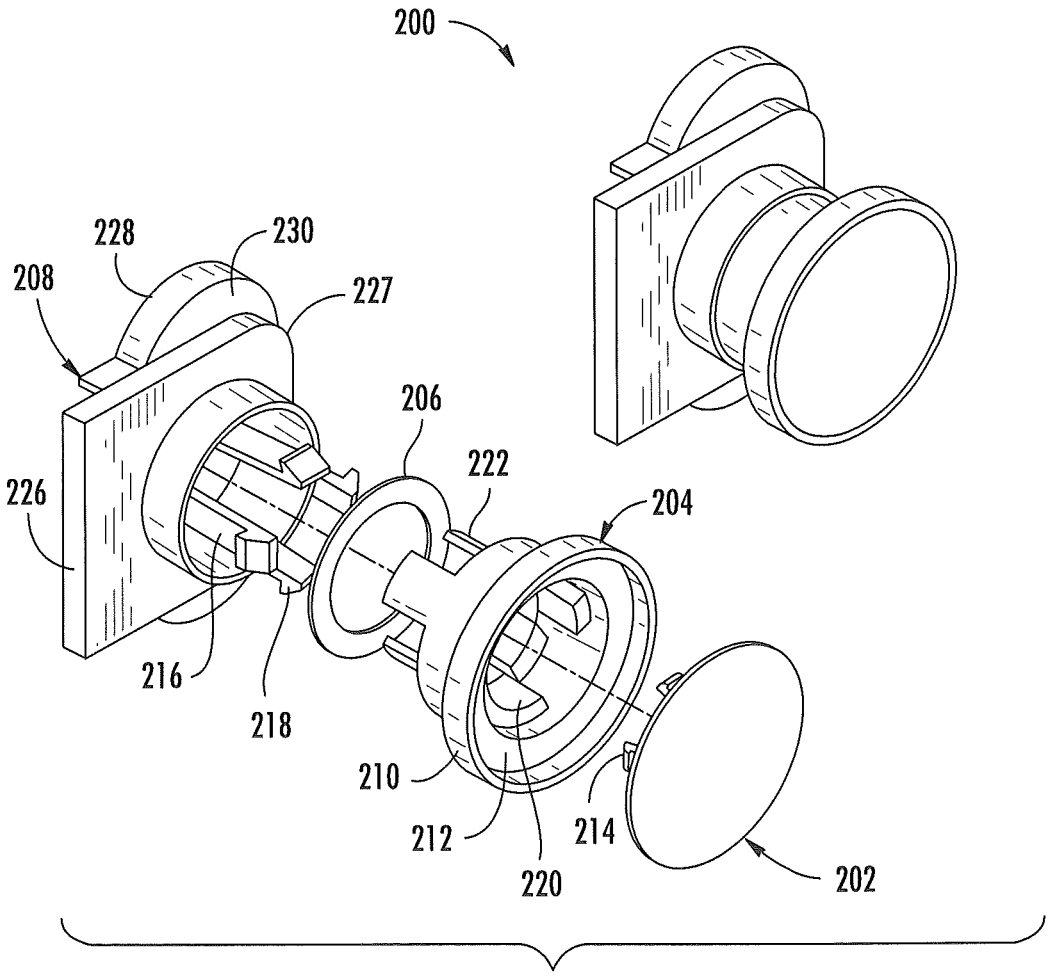
FIG. 2 is an exploded perspective view of a latch assembly.

FIG. 2 is an exploded perspective view of a latch assembly 200. Latch assembly 200 includes a cap 202, knob 204, gasket 206 and latch 208. When assembled to door 100, gasket 206, knob 204 and cap 202 are positioned on a front side of door 100 and latch 208 is positioned on a backside of door 100. Knob 204 has a cylindrical knob body 210 having a recess 212 at a first end for receiving cap 202. Cap 202 includes resilient tabs 214 that snap into knob 204. As described in further detail with reference to FIG. 4, cap 202 includes snap features that once engaged, will prevent the resilient tabs 214 from unsnapping from the knob 204. Cap 202 provides a seal against air leakage through the knob 204.

Knob body 210 has an opening therethrough for receiving a plurality of spaced fingers 216 extending from the latch 208. Fingers 216 have prongs 218 extending radially outwardly that are received over an interior lip defining recess 212 to snap fittingly secure the knob 204 and latch 208. Shoulders 220 on an interior surface of knob body 210 abut against fingers 216. The interference between shoulders 220 and fingers 216 causes rotation of knob 204 to rotate latch 208. Knob body 210 also includes a plurality of extensions 222 that are received in pockets 224 (FIG. 1) in the latch 208, between respective fingers 216. The interference between the extensions 222 and the pockets 224 causes rotation of knob 204 to rotate latch 208. Gasket 206 provides an airtight seal between the knob 204 and the door 100.

Latch 208 includes a generally rectangular latch body 226. Latch body 226 includes two arcuate, cam surfaces 227. As the knob 204 and latch 208 are turned from an unlatched state to a latched state, one cam surface 227 rides on an edge of the casing 102 to move the door 100 in a vertical direction. Two semi-circular latch tabs 228 extend away from latch body 226 and have a latch tab surface 230 distanced from and parallel to the surface of the latch body 226. As shown in FIG. 1, the latch tab surface 230 is positioned behind the furnace casing the pull the door 100 tight against the furnace casing 102 in the latched position. The latch tab surface 230 is chamfered to facilitate positioning of the latch tab 228 behind the casing as the latch 208 rotates. The edge of latch body 226 rests on an edge of casing 102 to position door 100 in the vertical direction. The latch body 226 has a flat detent 229 (FIG. 3) on an edge thereof that rests on the edge of the casing 102 in the latched position.

When the latch 200 is in a first orientation (e.g., latch tabs 228 aligned horizontally), door 100 can be mounted against casing 102 as latch body 226 clears the opening in casing 102. As knob 204 is rotated (either clockwise or counter-clockwise), a cam surface 227 contacts an edge of the casing 102 to move the door in a vertical direction as knob 204 is rotated. Latch tab 228 moves behind casing 102 to pull door 100 against casing 102 with latch tab surface 230 in contact with casing 102. As the latch 208 is rotated, this forces the door to be moved vertically while compressing casing insulation. Once the latch assembly 208 has rotated 90 degrees, detent 229 (FIG. 3) on the edge of latch body 226 rests on an edge of casing 102, locating the door vertically.

Figure 3:
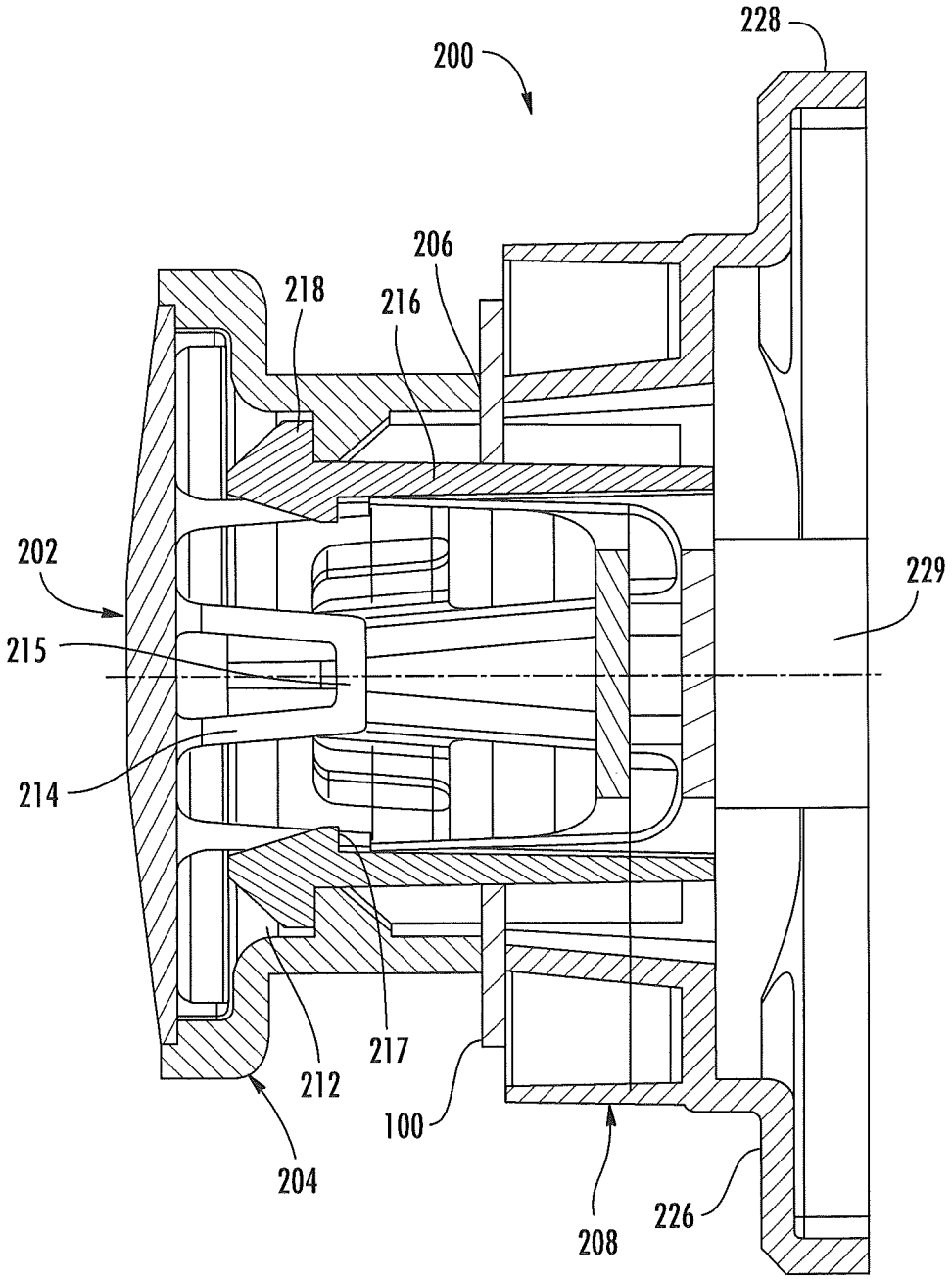
FIG. 3 is a cross-sectional view of the latch assembly.

FIG. 3 is a cross-sectional view of a latch assembly 200 mounted on door 100. As shown in FIG. 3, the resilient tabs 214 have an edge 215 that is received under a lip 217 extending radially inwards from fingers 216. In this construction, the resilient tabs 214 are secured to fingers 216 and prevent fingers 216 from being disengaged from knob 204 until cap 202 is removed. The cap 202 is keyed to the knob 204 (e.g., via a notch on the cap 202 and a tab on knob 204, or vice versa) so that the cap 202 and knob 204 only mate in a single orientation. Further, the knob 204 and latch 208 are keyed, so that the knob 204 and latch 208 only mate in a single orientation 204 (e.g., via a notch on the knob 204 and a tab on latch 208, or vice versa). Flat detent 229 is provided on the surface of latch body 226 to coincide with an edge of casing 102 once the latch assembly 200 has been rotated to the latched position.

Embodiments of the invention attach furnace doors to a casing and provide a tight seal against either the top or bottom plate insulation and front edges of casing. Latches are rotatable and operate either clockwise or counter clockwise. The latches are air tight in their design, snap together, not easily come apart, and hold door secure over the operating life of the furnace. The snap together design allows door to be swapped between the top and bottom compartments and the latches can be oriented correctly. The latches provide a tight seal to restrict air flow into the combustion compartment, increasing burner reliability.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A latch assembly for securing a furnace door to a furnace casing, the latch assembly comprising:

a latch for placement on an inside of the furnace door;

a knob for placement through a hole in the furnace door, the knob snapped into the latch, the knob for placement on a front surface of the furnace door;

a cap secured at an end of the knob;

the latch including a plurality of spaced fingers, each finger having a prong extending radially outward;

the knob including a knob body having an opening therethrough, the knob body having a recess defined by an interior lip, the prongs extending into the recess and over the lip to snap fittingly secure the latch to the knob.

2. The latch of claim 1 wherein:

the latch, knob, and cap are keyed to allow assembly in only one orientation.

3. The latch of claim 1 wherein:

the knob body includes a plurality of shoulders formed on an interior surface thereof, each shoulder being positioned adjacent to a respective one of the fingers.

4. The latch of claim 3 wherein:

the knob body includes a plurality of extensions the latch includes a latch body, the latch body having a plurality of pockets, each pocket receiving a respective one of the plurality of extensions.

5. A latch assembly for securing a furnace door to a furnace casing, the latch assembly comprising:

a latch for placement on an inside of the furnace door;

a knob for placement through a hole in the furnace door, the knob snapped into the latch, the knob for placement on a front surface of the furnace door; and a cap secured at an end of the knob;

the latch includes a latch body and at least one latch tab extending from the latch body, the latch tab for contacting the furnace casing in a latched position.

6. The latch of claim 5 wherein:

the latch body includes two latch tabs.

7. The latch of claim 5 wherein:

the latch body includes a surface, the at least one latch tab having a chamfered latch tab surface distanced from the surface, the latch tab surface engaging the furnace casing in a latched position.

8. The latch of claim 7 wherein:

the latch body rests on an edge of the casing in the latched position and is held in place by a detent on the latch body.

9. A latch assembly for securing a furnace door to a furnace casing, the latch assembly comprising:

a latch for placement on an inside of the furnace door;

a knob for placement through a hole in the furnace door, the knob snapped into the latch, the knob for placement on a front surface of the furnace door; and a cap secured at an end of the knob;

the latch includes a latch body and at least one latch tab extending from the latch body, the latch tab for contacting the furnace casing in a latched position;

the latch body includes a surface, the at least one latch tab having a chamfered latch tab surface distanced from the surface, the latch tab surface for contacting the furnace casing in a latched position;

the latch body includes a cam surface, the cam surface for traveling over the furnace casing, forcing the door to be moved vertically and compressing casing insulation, as the knob is rotated.

10. The latch of claim 6 wherein:

the latch secures the door in place by rotating either clockwise or counter clockwise.

11. The latch of claim 1 wherein:

each finger includes a lip extending radially inwardly opposite the prong;

the cap includes tabs having an edge;

each tab being secured to a respective finger by an overlap of the lip and the edge.

* * * * *